US005504270A

United States Patent [19]

Sethares

[11] Patent Number: 5,504,270

[45] Date of Patent: Apr. 2, 1996

[54] METHOD AND APPARATUS FOR DISSONANCE MODIFICATION OF AUDIO SIGNALS

[76] Inventor: William A. Sethares, 622 N. Henry St., Madison, Wis. 53706

[21] Appl. No.: 297,446

[22] Filed: Aug. 29, 1994

[51] Int. Cl.[6] ..... G10H 1/12; G10H 7/08

[52] U.S. Cl. ..... 84/645; 84/659; 84/699; 84/DIG. 9

[58] Field of Search ..... 84/622–625, 645, 84/659–661, 692–700, 735, 736, DIG. 9

[56] References Cited

PUBLICATIONS

Tonal Consonance and Critical Bandwidth, Plomp et al., The Journal of the Acoustical Society of America, 1965, pp. 548–560.

Consonance Theory Part I: Consonance of Dyads, Kameoka et al. The Journal of the Acoustical Society of America, 1969, pp. 1451–1459.

Consonance Theory Part II: Consonance of Complex Tones . . . Method The Journal of the Acoustical Society of America, 1969, pp. 1460–1469.

*Primary Examiner*—Stanley J. Witkowski

*Attorney, Agent, or Firm*—Victor E. Libert; Frederick A. Spaeth

[57] ABSTRACT

A method and apparatus for analyzing and reducing or increasing the dissonance of an electronic audio input signal are realized by identifying the partials of the audio input signal by frequency and amplitude. The dissonance of the input partials is calculated with respect to a set of reference partials according to a procedure disclosed herein. One or more of the input partials is then shifted, and the dissonance re-calculated. If the dissonance changes in the desired manner, the shifted partial may replace the input partial from which it was derived. An output signal is produced comprising the shifted input partials, so that the output signal is more or less dissonant that the input signal, as desired. The method may be used with computerized sound processing equipment, e.g., MIDI-based equipment. The input signal and reference partials may come from different sources, e.g., a performer and an accompaniment, respectively, so that the output signal is a more or less dissonant signal than the input signal with respect to the source of reference partials. Alternatively, the reference partials may be selected from the input signal to reduce the intrinsic dissonance of the input signal.

26 Claims, 6 Drawing Sheets

METHOD AND APPARATUS FOR DISSONANCE MODIFICATION OF AUDIO SIGNALS

BACKGROUND OF THE INVENTION

Field of the Invention

This invention relates to manipulation of audio signals, and more particularly to method and apparatus for changing the timbre, tuning and/or intonation of audio signals.

When two ordinary musical notes are played together they define an interval between them corresponding to the difference between their scale tones. A musical interval is generally considered to be consonant if it sounds pleasant or restful; a consonant interval has little or no musical tension. Dissonance is the degree to which an interval sounds unpleasant or rough; dissonant intervals generally sound tense and unresolved. Certain musical intervals are widely perceived as consonant (for instance the notes C and G on a piano) while other intervals are perceived as dissonant (for instance, the notes C and C sharp on a piano). Intervals are usually expressed in terms of scale tones between the notes in question, and the characteristic dissonance or consonance of an interval is generally independant of the absolute pitches of the notes. Thus, the half-tone interval C-C sharp is conventionally considered to be equivalent to the half-tone interval G-G sharp despite the shift in absolute pitch. Stated in musical jargon, intervals can be transposed without losing their characteristic dissonance or consonance. Intervals can be identified in several different ways. For example, the interval C-G can be described as the interval of a fifth (i.e., five tones of a major scale based on the lower note, C), or as an interval of seven semitones (based on a standard, tempered, 12-tone scale), or as a freqency ratio of about 1:1.5.

Dissonance may also be perceived among groups of notes. Thus, when a performer plays or sings out of tune with an accompanying orchestra, or when an instrument has not been properly tuned, the result is quickly perceived as being dissonant.

As part of the study of the perception of musical sounds, the physical attributes of accoustical phenomenon have been taken into consideration. For example, it has long been recognized that sound phenomena travel through the air in waves, and musical sounds are generally characterized as having the wave attributes of frequency and amplitude. The frequency attribute is generally associated with the pitch of the sound, i.e., whether the note is high or low, whereas the amplitude is associated with loudness.

In studying the perception of consonance and dissonance, Plomp et al, as reported in the article "Tonal Consonance and Critical Bandwidth", 38 JASA, 548–560 (1965), asked a number of volunteers to rate the dissonance or consonance of a pair of "pure" tones, i.e., tones having wave forms corresponding to sine waves. The two tones were played together, and one was kept at a constant reference frequency while the frequency of the other was slowly changed. The results of the study are set forth in FIG. 1, which shows that as the interval between the two tones increased, the dissonance between them was first perceived to increase, and then to decrease. Contrary to conventional belief regarding ordinary tones, the interval at which maximum dissonance was perceived for the pure tones, sometimes referred to herein as the "critical interval", was different for different reference frequencies, as indicated by the various curves in the graph of FIG. 1. For example, when the reference, i.e., unison, frequency was 125 Hz, the critical interval was about four semitones; whereas at a reference frequency of 2000 Hz, the critical interval was about one semitone. Generally, the higher the reference frequency, the smaller the critical interval and the more quickly dissonance dissipated as the interval between the tones increased beyond the critical interval.

SUMMARY OF THE INVENTION

Generally, the present invention provides a method and apparatus for receiving an electronic audio input signal comprising at least one input partial, evaluating the dissonance of the input signal relative to a set of reference partials, and for producing an output signal having greater or, more typically, smaller dissonance than the input signal.

Specifically, the invention relates to a method for producing an electronic audio output signal from an electronic audio input signal comprising at least one partial by identifying by frequency and amplitude at least one input partial of the input signal. The dissonance between at least one of the identified input partials, designated a "dissonant partial", and a plurality of reference partials is calculated. A tuned partial near to the at least one dissonant partial is identified by frequency and amplitude, the amplitude being the same as the amplitude of the dissonant partial, the frequency giving the tuned partial a dissonance that differs in a predetermined way from that of the dissonant partial relative to the reference partials, i.e., having a dissonance greater or lesser than that of the dissonant partial. An electronic audio output signal comprising the input partials except for the at least one dissonant partial, and further comprising each identified tuned partial, is then produced.

According to one aspect of the present invention, identifying an input partial may comprise associating with the input partial a frequency $f_i$ and an amplitude $\nu_i$. Each reference partial may also have associated therewith a frequency $f_j$ and an amplitude $\nu_j$. Optionally, identifying the at least one input partial may comprise selecting a MIDI timbre and assigning the timbre to an input pitch designated by using a MIDI controller device, Alternatively, identifying the at least one input partial may comprise passing an analog electronic input signal through an analog-to-digital converter and a frequency analyzer means to derive an input partial spectrum from the analog input signal. Optionally, the method may comprise identifying the reference partials in either of these manners. Then, the dissonance of a set of m input partials and n reference partials may be designated D and may be calculated as follows:

$$D = 1/2 \sum_{i=1}^{n+m} \sum_{j=1}^{m+n} d(f_i, f_j, \nu_i, \nu_j),$$

wherein: d $(f_i, f_j, \nu_i, \nu_j)$ defines a dissonance function that reaches a maximum. dissonance at about the critical interval for frequencies $f_i$ and $f_j$.

According to another aspect of the invention, identifying the tuned partial may comprise identifying a local dissonance minimum near the dissonant partial.

According to still another aspect of the invention, identifying the tuned partial may comprise identifying a trial partial having an amplitude corresponding to that of the dissonant partial and having a frequency within a predetermined interval from that of the dissonant partial; calculating the dissonance for the trial partial, and designating the trial partial as a tuned partial for the dissonant partial if the dissonance of the trial partial differs in the predetermined manner from the dissonant partial.

Typically, the trial partial as a tuned partial may be chosen if its dissonance is less than that of the dissonant partial.

Optionally, the reference partials may be selected either from the input signal or from a reference signal separate from the input signal.

Still another aspect of the invention provides that the input signal may be an analog signal. In such case, identifying the at least one input partial may comprise analyzing the input signal to yield a frequency and amplitude domain.

In a particular embodiment, choosing the tuned partial may comprise determining the dissonance gradient for a dissonant partial, multiplying the gradient by a scaling factor $\mu$ to produce a frequency differential; and choosing a trial partial having a frequency that differs from that of the dissonant partial by the frequency differential as the tuned partial. Optionally, the method may further comprise repeating these steps, using the trial partial as the dissonant partial, until the frequency differential becomes less than or equal to a predetermined limit $\delta$ or until a local minimum dissonance is reached. Alternatively, when the input signal comprises a plurality of input partials, choosing the tuned partial may comprise determining the dissonance gradient for changes in pitch of the input signal, multiplying the gradient by a scaling factor $\mu$ to produce a pitch differential, and choosing new trial partials that have frequencies that differ from their respective input partials by the pitch differential. The new trial partials may be chosen as tuned partials, or the process may be repeated until the pitch differential becomes less than or equal to a predetermined limit $\delta$ or until a local minimum dissonance is reached.

In a particular embodiment, the invention provides a method for producing a MIDI output signal comprising using a MIDI controller device to designate one or more pitches. A timbral spectrum to be associated with the designated pitches is identified, to define a spectrum of input partials each having a frequency $f_i$ and amplitude $v_i$. The dissonance of the input partials is calculated with respect to a set of reference partials each having a frequency $f_j$ and amplitude $v_j$. An output pitch at which the input partials define a local minimum dissonance relative to the reference partials is identified, and output MIDI signal that associates the previously identified timbral spectrum with the output pitch is produced.

The invention also provides a device for changing the dissonance of an electronic audio input signal. The device comprises (a) input signal means for receiving an audio input signal comprising at least one input partial, (b) reference signal means for identifying by frequency and amplitude a plurality of reference partials, (c) dissonance analyzer means for calculating the dissonance of at least one of the input partials designated a dissonant partial, relative to the reference partials, and for identifying by frequency and amplitude a tuned partial near each dissonant partial, the tuned partial having a dissonance that differs from that of the respective dissonant partial in a predetermined way, the amplitude of the tuned partial being the same as the amplitude of the respective dissonant partial, and (d) synthesizer means for producing an output signal comprising the input partials except for each dissonant partial and further comprising each tuned partial identified by the dissonance analyzer means.

According to one aspect of the invention, at least one of the reference signal means and the input signal means may comprise an analog-to-digital converter and frequency analyzer means for identifying by frequency and amplitude one or more partials from an analog signal. Optionally, at least one of the input signal means and the reference signal means may comprise a plurality of bandpass filters.

According to yet another aspect of the invention, at least one of the input signal means and the reference signal means may comprise a MIDI controller device and a MIDI compatible timbre source means operably connected to the controller device for assigning a timbral spectrum to a pitch designated by the controller device. Optionally, the device may comprise reverse Fourier transfer means to produce a digital audio output signal on the output partials.

DETAILED DESCRIPTION OF THE INVENTION AND PREFERRED EMBODIMENTS THEREOF

Figure 1:
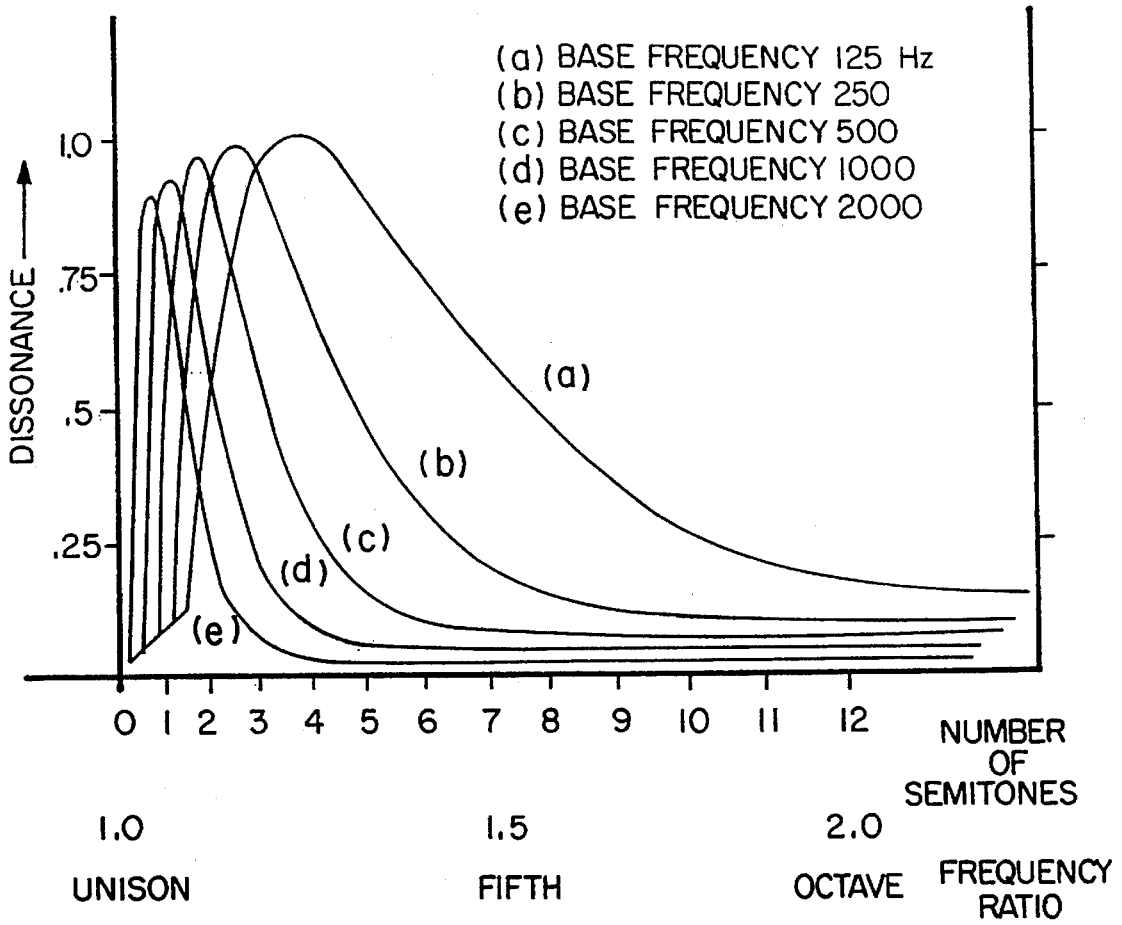
FIG. 1 (PRIOR ART)
FIG. 1 is a graph of data known in the art showing the dissonance between two pure tones as a function of base frequency and tone interval.

The waveform of an ordinary musical sound is typically fairly complex. Nevertheless, a musical waveform can often be represented as the sum of a number of "pure" sinusoidal tones or "partials" of the sound, which can be determined by applying a Fourier analysis to the waveform. The result of the analysis is a description of the musical sound as a collection of sinusoidal waves having specified frequencies, amplitudes and phases. These sinusoidal constituents are referred to as "partials". The partial having the lowest frequency is referred to herein and in the claims as the "fundamental". Typically, the fundamental of a musical sound corresponds to the note being played. Thus, when a piano sounds A(440), the fundamental of the sound wave has a frequency of 440 Hz, and the other partials have higher frequencies and, as discussed below, produce the timbre of the note.

Without wishing to be bound by any particular theory, the Fourier analysis provides more information than is necessary to analyze a musical sound with respect to human perception, because the perception of sounds is generally independent of the phase of the partials of a sound. Therefore, while there are a large number of waveforms that can be produced from a pair of partials having frequencies $f_1$, $f_2$ and amplitudes $v_i$, $v_2$, by shifting the phase relationship between the partials, all of these combinations will be perceived as the same musical sound.

The ability of a listener to distinguish between two musical instruments playing the same note has been attributed to differences in the timbre of the respective notes. The use of Fourier analysis leads to the explanation that differences in timbre are attributable to differences in the relative amplitudes in the partials produced by the instrument above the fundamental.

In accordance with the present invention, at least some of the partials of a given electronic audio input signal are identified and are referred to as input partials, and the degree of dissonance of each is compared to a series of reference partials. The reference partials may be derived from the input signal, from a separate reference signal, or from another source. A partial dissonance is determined for each input partial by adding the dissonance of the input partial with respect to each of the reference partials. A total dissonance for the input signal is derived from a sum of the partial dissonances of the input partials. The input signal may be in digital form, e.g., in DAT (Digital Audio Tape) format, or in analog form, e.g., from a microphone. An analog input signal can be converted to digital form by a conventional analog-to-digital converter, the output of which can be transferred to a real time analyzer to calculate the spectrum of partials of the signal using FFT, a well-known fast method for calculating Fourier transforms.

According to the present invention, the dissonance d between a pair of pure tone partials, referred to herein as the partial dissonance, is quantified by using the frequency and amplitude characteristics as variables in a mathematical formula. Preferably, the formula approximates the perceptual data reported in the prior art with respect to pure tone dissonance. i.e., it yields a maximum dissonance volume corresponding to the critical interval for the frequencies specified in the formula, and dissonance decreases at larger or smaller intervals. Thus, the partial dissonance d between two partials may be expressed as:

EQUATION 1(A)

$$d(f_1, f_2, v_1, v_2)=v_1\, v_2(e^{-a\Delta f}-e^{-b\Delta f})$$

wherein: $\Delta f=f_2-f_1$, and a and b are chosen so that the partial dissonance function reaches a maximum of about the critical interval for the tones as reported by the aforesaid Plomp et al article. The value of "a" may range from about 0.5 to about 5.0, more preferably from about 3 to about 4, for example, "a" may equal about 3.5. The value of "b" may range from about 1 to about 10, preferably from about 5 to about 6, e.g, "b" may equal about 5.75. In a particular embodiment the partial dissonance function may be expressed as:

EQUATION 1(B)

$$d(f_1, f_2, v_1, v_2) = v_1\, v_2\, [e^{-as(\Delta f)} - e^{-bs(\Delta f)}] \qquad \text{Equation 1(B)}$$

$$\text{where } S = \frac{0.24}{0.021 \min(f_1, f_2) + 19.0},$$

and $\Delta f=f_2-f_1$, and a=3.5, and b=5.75, and min ($f_1$, $f_2$) indicates choosing the smaller of $f_1$ and $f_2$ to multiply by 0.021.

Those skilled in the art will appreciate that mathematical substitutes for Equations 1(A) and 1(B) may be used to create partial dissonance functions having the same characteristics as the formulae defined above. For example, the partial dissonance can be expressed as:

EQUATION 1(C)

$$d(f_1, f_2, v_1, v_2)=v_1\, v_2\, [(\Delta f)^a]e^{b\Delta f}$$

or

EQUATION 1(D)

$$d(f_1, f_2, v_1, v_2)= v_1\, v_2[(\Delta f)^4-a(\Delta f)^3+b(\Delta f)^2+c\Delta f+e]$$

where a, b, c and e are chosen as described above.

Any such partial dissonance function can be used in the practice of the present invention.

The total dissonance between an input signal comprising partials $f_i$, $v_i$ and a reference signal comprising $f_j$, $v_j$, can be represented as a total dissonance value D as shown in Equation 2.

EQUATION 2

$$D = 1/2 \sum_{i=1}^{n+m} \sum_{j=1}^{m+n} d(f_i, f_j, v_i, v_j)$$

wherein: the function d defines a partial dissonance function such as those described in Equations 1(A), 1(B), 1(C), 1(D) or the like, where n is the number of partials of the input signal, or "input partials" and m is the number of partials of the reference signal, or "reference partials". Generally, in accordance with the present invention, the dissonance between one or more audio input signals and a series of reference partials is calculated, and an audio output signal is produced as a substitute for the audio input signal. The audio output signal may be in digital form suitable for further processing, or may be converted to analog form for listening or analog recording. Typically, the input signal varies with time, as may the reference signal from which the reference partials are derived and in such case temporal portions of the respective signals are matched together for purposes of the dissonance calculation and production of the output signal. In other words, the input signal and the reference signal are synchronized. Synchronization may be achieved in "real time" by sounding the input signal and the reference signal together, or it may be achieved by matching time domains of digitalized input and reference signals.

The output signal is characterized in that it is synthesized from partials that correspond to the partials of the input signal, but one or more output partials has a frequency different from that of its corresponding input partial. The deleted input partial is sometimes referred to herein and in the claims as a "dissonant partial"; the substitute output partial is sometimes referred to in the claims as a "tuned partial". For the sake of ease of expression, the process of producing an output signal in place of an input signal in accordance with the present invention is sometimes referred to herein and in the claims as "moving", "shifting", or "tuning" the partials of the input signal. Thus, in accordance with the present invention, one or more input partials may be shifted or tuned to change the dissonance of the input signal. Optionally, all of the input partials may be shifted by the same interval, so that the output signal will have roughly the same timbre as the input signal. In other words, the present invention can be used to adjust the pitch of an input signal to reduce its total dissonance relative to a reference signal. This approach can be advantageous when the timbre of the input signal is important to the listener, e.g., when the input signal is derived from a vocalist, a solo instrument or the like. When any of the methods described herein shift a dissonant partial to the same frequency as a reference partial or to a frequency having a local minimum of dissonance, this may be referred to as the input partial "converging" with the reference partial or with the local minimum frequency. Similarly, when the methods described herein shift two or more input partials to the same frequency, the input partials are said to "merge together".

In effect, the present invention may be used to process an input signal by shifting or tuning one or more of the input partials so that they have more desirable dissonance characteristics. For example, the method disclosed herein may be used to produce output partials that are less dissonant than the input partials, so the output signal will be more consonant than the input signal. However, the invention is not limited to the reduction of dissonance; in certain applications, it may be desired to produce an output signal having a greater total dissonance than the input signal, to create musical tension or to yield a special sound effect. As stated below, the invention may be practiced using computer software, which can be written to allow the user to choose in advance whether to increase or decrease dissonance between an input signal and a set of reference partials, as desired. For ease of description, the discussions and Examples that follow may address only the reduction of dissonance between an input signal and reference partials. However, it will be apparent upon reading and understanding the present disclosure that the invention is not limited to the reduction of dissonance, but can be used to increase dissonance if it is desired to do so. Broadly stated, the method and apparatus of the present invention allows the user to exercise control over the dissonance characteristics of the input signal. The reference partials may be selected from a signal to be played simultaneously with the input signal. For example, the input signal may be a singer's voice, and the reference partials may be selected from the signal derived from the sound of an accompanying instrument. Thus, should the singer hit a "sour" note, an apparatus according to the present invention could be used to tune or harmonize the singer with the accompaniment. Alternatively, the reference partials may be selected from the input signal, e.g., from some or all of the input partials, in which case the dissonance of the input signal calculated according to Equation 2 is referred to as the "intrinsic" dissonance of the signal. By using the present invention, the intrinsic dissonance of an input signal may be reduced or increased as desired. Accordingly, the method of the present invention may include choosing a source from which the reference partials are selected, e.g., from the input signal, from a reference signal, or from a pre-determined set of reference partials.

One suitable method that can be employed to chose a tuned partial to replace a dissonant partial is to choose a trial partial having the same amplitude as the dissonant partial and a frequency that differs from the dissonant partial by a fixed interval. The dissonance of the trial partial is calculated with respect to the reference partials, as specified by Equation 2, and is compared to the dissonance of the dissonant partial. Thus, to reduce the dissonance of the input signal, the dissonance of a trial partial is calculated and, if it is lower than that of the corresponding dissonant partial, the trial partial may be chosen as the tuned partial for the output signal.

Optionally, the process may be repeated in an iterative fashion so that the dissonance of a second trial partial is compared to that of the first trial partial, and a third trial partial is compared to the second, and so on, as long as the dissonance continues to change in the desired direction. Thus, in the iterative application of the process, if a trial partial is not used as a tuned output partial, it becomes treated like a dissonant partial. A limit to the iterations may be imposed so that the input signal is not altered too dramatically, or to avoid excessive computation. For example, a limit may be set on the number of iterations performed, or on the interval distance between the original input partial and a trial partial. The limitation may be predetermined or may be derived from the input signal or the reference signal, e.g., it may be desirable to require that a trial partial be no further from its corresponding input partial than one-half the interval between that input partial and the next lower or higher input partial.

Another strategy for choosing a trial partial is to approximate the rate at which the total dissonance value D changes with respect to changes in the frequency for a given input partial, i.e., the dissonance gradient dD for that partial. Then, a trial partial can be chosen by multiplying the dissonance gradient by a predetermined scaling factor $\mu$ to produce a trial frequency differential. Typically, $\mu$ may be chosen to be between about 0.01 and 0.001. The trial frequency differential is subtracted from the frequency of the input partial to yield the frequency of a trial partial that can be used as a tuned output partial. Accordingly, the scaling factor is chosen as a positive value to decrease dissonance or as a negative value to increase dissonance. Optionally, a predetermined limit $\delta$ for the frequency differential may be chosen, and for the partials having a frequency differential that exceeds $\delta$, the process may be repeated in an iterative fashion by treating the trial partials as dissonant partials, calculating their dissonance gradients, using the scaling factor to choose a frequency differentials to choose new trial partials, etc., until each frequency differential is reduced to less than or equal to the predetermined limit, or until a local minimum in dissonance is reached. The iteration may then be stopped for that partial and the last trial partial is chosen as the tuned partial. The output signal comprises the tuned partials and any remaining un-tuned input partials.

The iterative method for selecting a tuned output partial can be performed simultaneously for each of a plurality of input partials, in which case dD is preferably based on the change in the total dissonance as the input signal changes in pitch, i.e., as all the input partials change together. In each iteration, the frequency differential is applied to the fundamental of the input signal and the remaining input partials are shifted accordingly. In such case, the frequency differential may be referred to as a pitch differential.

The differential limit $\delta$ used in the iterative processes described above may be expressed as an interval relative to the frequency of the partial for which the gradient was most recently calculated. Thus, the limit $\delta$ may be expressed in terms of "cents", there being 100 cents to a standard semitone interval, and should not exceed the precision of the output device in producing output signals. In a MIDI (Musical Instrument Digital Interface)-based system a typical value for $\delta$ is two cents.

If, during any of the methods described above for reducing dissonance, the dissonance of a trial partial increases rather than decreases, a local minimum in the dissonance of the corresponding input partial has been identified, and, preferably, the trial partial corresponding to the local minimum of dissonance is chosen as the tuned partial, and the iteration is stopped for that input partial.

As indicated above, the method of the present invention is applied to at least one of the input partials of an input signal, optionally, to a plurality of input partials, i.e., all or some of the input partials. For example, it may be decided to shift only a limited number of partials, e.g., the seven partials having the greatest amplitudes, to obtain substantial dissonance reduction without undue calculation. Alternatively, it may be desired to shift only partials having relatively small amplitudes, so that the output signal is merely a fine-tuned version of the input signal. Optionally, all the input partials may be shifted. If it is desired to maintain the timbre of the input signal, all the input partials are shifted by the same interval. In such case, after choosing one tuned partial, e.g., for the fundamental input partial, all the input partials are shifted by a corresponding interval, and the total resulting dissonance of the entire set of partials is calculated and compared to that of the input partials.

Figure 2:
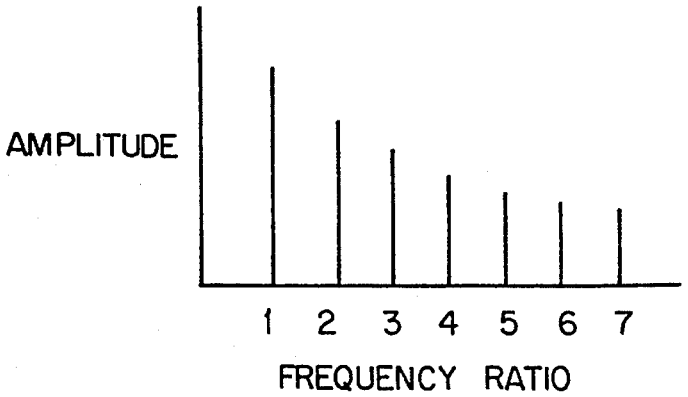
FIG. 2 is a graph showing amplitude on the vertical axis and relative frequency relation on the horizontal axis for seven sinusoidal signal partials.
Figure 3:
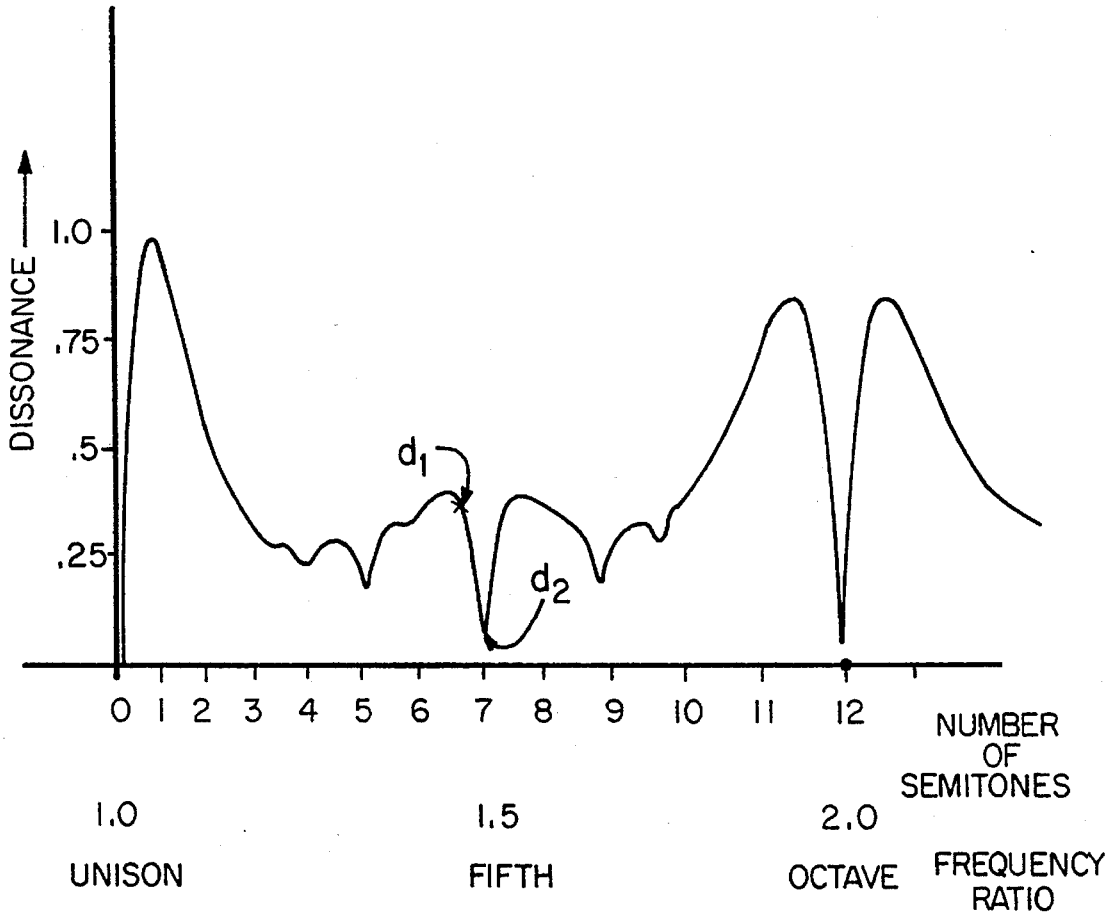
FIG. 3 is a graph showing dissonance on the vertical axis and fundamental interval on the horizontal axis for two seven-partial signals as shown in FIG. 2 as the interval between their respective fundamentals increases from unison.

Partials can be represented graphically, where the horizontal axis indicates frequency or relative intervals between partials and the vertical axis indicates amplitude. Partials can then be represented as a series of vertical lines extending upward from the horizontal axis to various heights. A simple example is shown in FIG. 2, which represents a series of seven partials having amplitudes that decrease at a relative rate of 0.88 and frequencies that increase as integer multiples of the frequency of the fundamental. When the total dissonance function described in Equation 2 is applied to a timbral input signal comprising seven input partials as shown in FIG. 2, with respect to a series of reference partials having the same amplitude and frequency relationships as the input partials, the total dissonance value D varies with the interval between the fundamental input partial and the fundamental reference partial as shown in FIG. 3, when the fundamental of the reference partial is at 500 Hz.

Figure 4A:
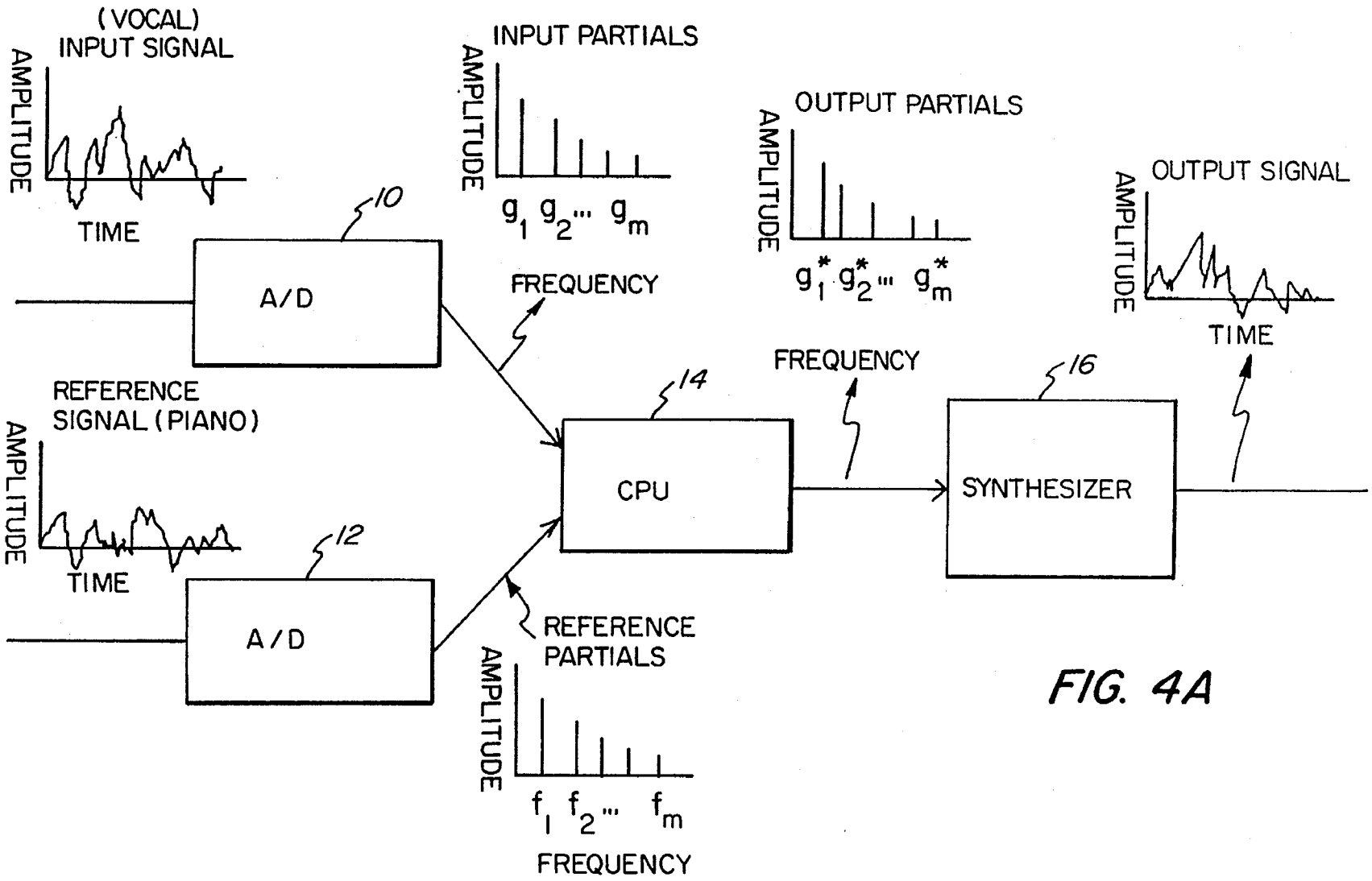
FIG. 4A is a schematic representation of one embodiment of an apparatus useful in the process of the present invention.

Given the quantity of calculations that must be performed to practice the invention, the invention is best realized using computerized equipment. For example, as shown schematically in FIG. 4A, an analog input signal such as a vocal input may be passed through an analog-to-digital converter 10 which is associated with a real time analyzer to produce a spectrum of input partials in digital form as a frequency and amplitude domain. Similarly, an analog reference signal such as the sound of an accompanying instrument may be introduced and passed through an analog-to-digital converter and real time analyzer 12. The input partials and the reference partials are accessed by a computer or microcomputer designated CPU 14 that may be programmed with a commercially available computer program such as MATLAB, XMATH or MATHEMATICA to perform the FFT calculations and the dissonance analysis and selection of output partials as described above. The digital frequency and amplitude output may then be reverse Fourier-transformed by the same computer program and passed to a digital-to-analog converter to be reproduced as sound or as a conventional audio signal that can be recorded for future playback or further processing.

Figure 4B:
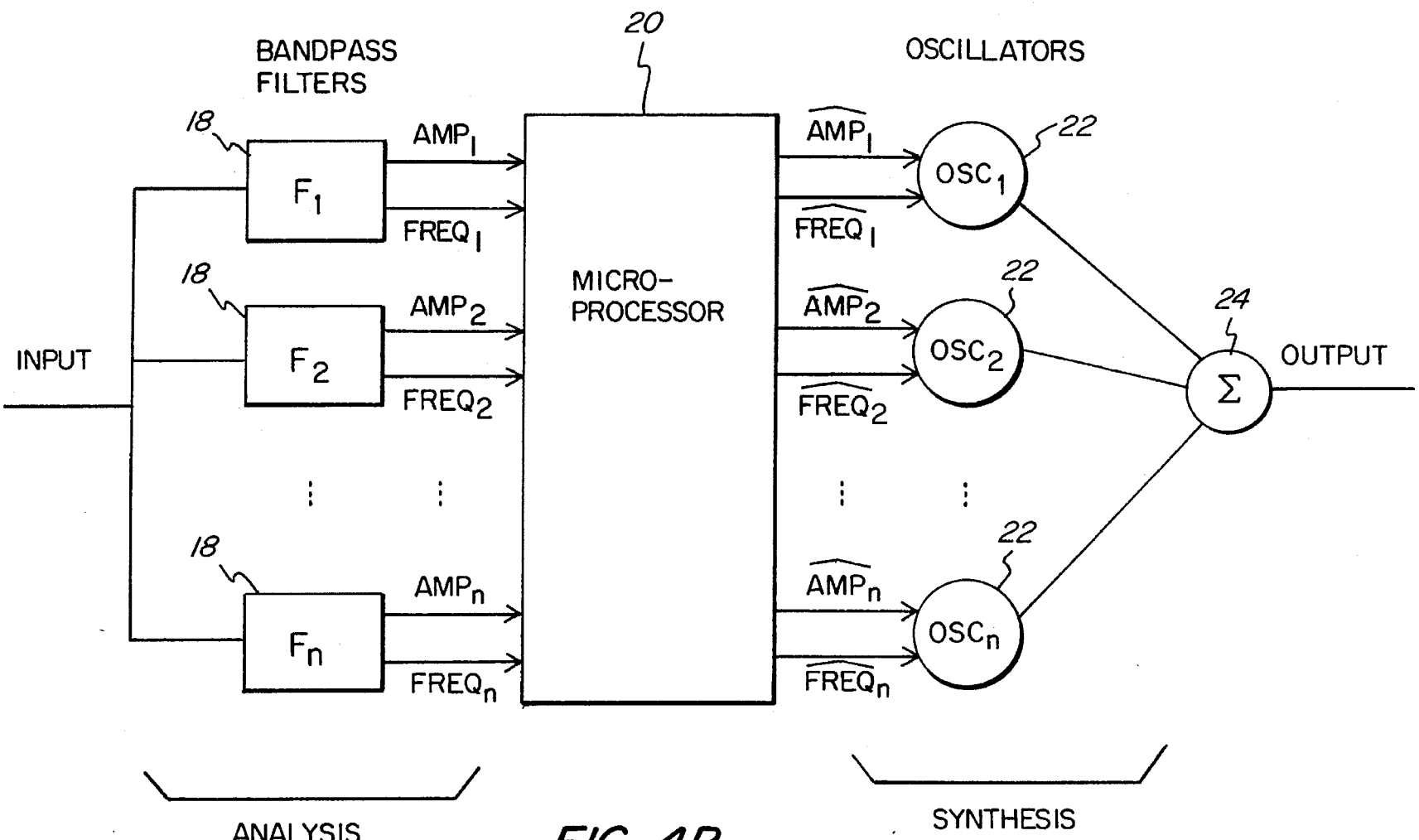
FIG. 4B is a schematic representation of another embodiment of an apparatus useful for the present invention.

In an alternative analog embodiment shown in FIG. 4B, an analog input signal may be passed through a series of bandpass filters 18 having differing pass-through frequencies $F_1$, $F_2$ . . . $F_n$ to analyze the signal in analog form according to characteristic frequencies. The amplitude of the signal derived from each bandpass filter is associated with the pass-through frequency of the filter, to produce the frequency-amplitude information required to determine dissonance in accordance with the present invention. The frequency and amplitude information is fed to a computer or microprocessor 20 programmed to carry out a dissonance reduction calculation described above. A signal of appropriate strength for each output partial is sent to an oscillator 22 which produces the output partial. The output of each oscillator is fed to an accumulator 24 where an output signal is produced from the output partials.

Figure 5:
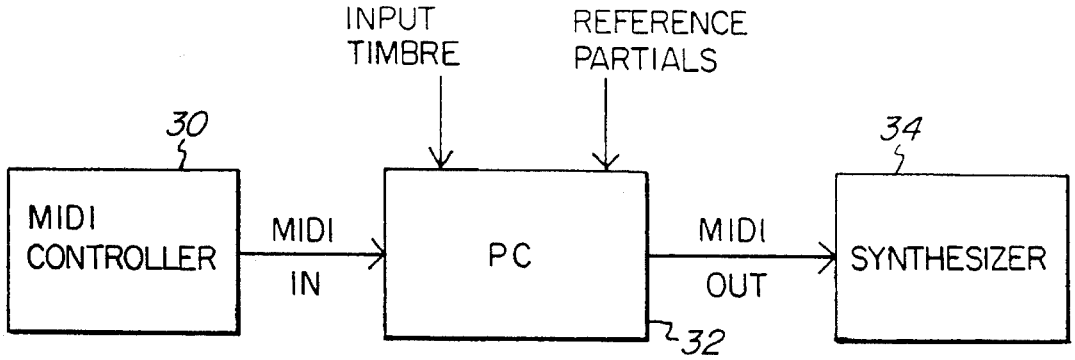
FIG. 5 is a schematic representation of a MIDI-based implementation of the present invention.

A MIDI-based implementation of the present invention shown schematically in FIG. 5 comprises a conventional MIDI controller device 30, the output of which is connected to a MIDI-equipped personal computer 32. The MIDI-out port of computer 32 is connected to a synthesizer 34. In use, the user specifies an input signal timbre comprising a characteristic profile of partials to be assigned to a note indicated by the MIDI controller. The user may provide the input timbre information using a conventional MIDI input device, or by accessing the timbre profiles from a database stored in computer 32. Then, the user operates the MIDI controller device 30, e.g., by depressing a key on a MIDI controller keyboard, to transmit a "note on" command and other associated, conventional MIDI control commands to computer 32. Computer 32 assigns the previously chosen timbre information to the pitch designated by the MIDI control command, to define a series of input partials. A choice of reference partials is also provided to computer 32, optionally by the same method as the input partials are produced. The computer is equipped with a program that allows it to access the input partials and the reference partials and to modify the dissonance of the input partials as previously described. Typically, the input partials are shifted together, i.e., the invention is implemented to shift the pitch of the input signal to a less dissonant output signal. When, for example, a desired pitch differential has been identified, a conventional MIDI "pitch bend" command can be used to alter the pitch designated by the MIDI controller to a pitch at which the input partials are less dissonant than at the original pitch. The chosen timbre is then assigned to the output pitch, and the resulting information is passed from computer 32 to a MIDI synthesizer 34, from which the output signal may be played or recorded in a conventional manner. Preferably, controller device 30, computer 32 and synthesizer 34 are integrated into a single device to eliminate the need to physically connect separate components and to simplify the transfer of command signals and timbre information.

In either of the embodiments of FIGS. 4 and 5, the software or the programming for the microprocessor may prompt the user to enter instructions reflecting choices for the source of the reference signal, the desired change in dissonance, iteration parameters and the other aspects of the process for producing the output signal. Alternatively, such choices may be made using foot pedals, switches, slides or other devices.

Optionally, a device according to the present invention may be equipped to combine the partials of a plurality of input signals which may comprise digital input signals, analog input signals or a combination of the two. Similarly, the reference partials may be derived from a plurality of digital or analog reference signals or a combination thereof.

EXAMPLE 1

Figure 6:
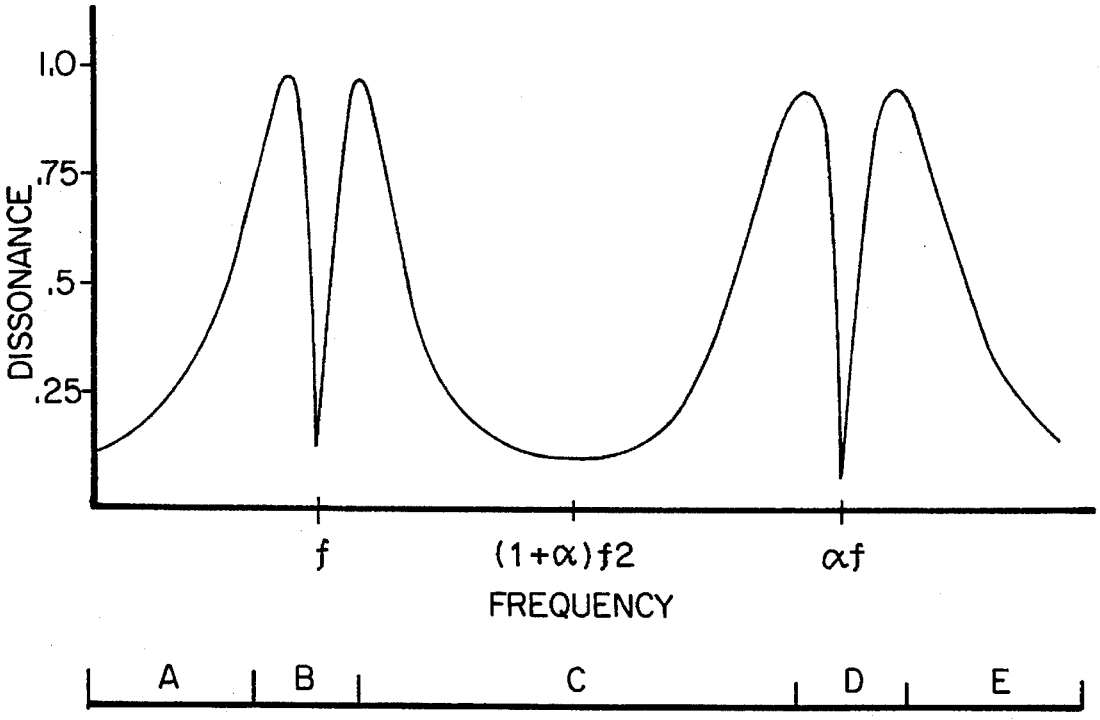
FIG. 6 is a graph showing the dissonance curve between a two-partial reference signal F having partials at frequencies f and $\alpha f$ and a single partial input signal.

Consider two notes F and G. Suppose that F consists of two reference partials of amplitude $\nu$ at frequencies f and $\alpha f$ with $\alpha>1$, and that G consists of a single input partial at frequency $g_0$ that is shifted in accordance with an iterative method discussed above. Points of minimum dissonance, as predicted in Equation 2, will be found at $g=f$, at $g=\alpha f$ and at $g=(1+\alpha)f/2$. FIG. 6 shows the corresponding dissonance curve. If the input frequency of g is far below f or above $\alpha f$ (e.g., in regions A or E), then the iterative dissonance reduction method described above will fail to identify a local minimum value for dissonance. On the other hand, if the input frequency of g is near enough to f or $\alpha f$ (e.g., in regions B or D), then g ultimately converges on f or $\alpha f$. In region C, the iterative dissonance reduction method described above will produce a series of substitute tones that move away from the closer of f or $\alpha f$, converging on toward a minimum dissonance between them.

EXAMPLE 2

Figure 7:
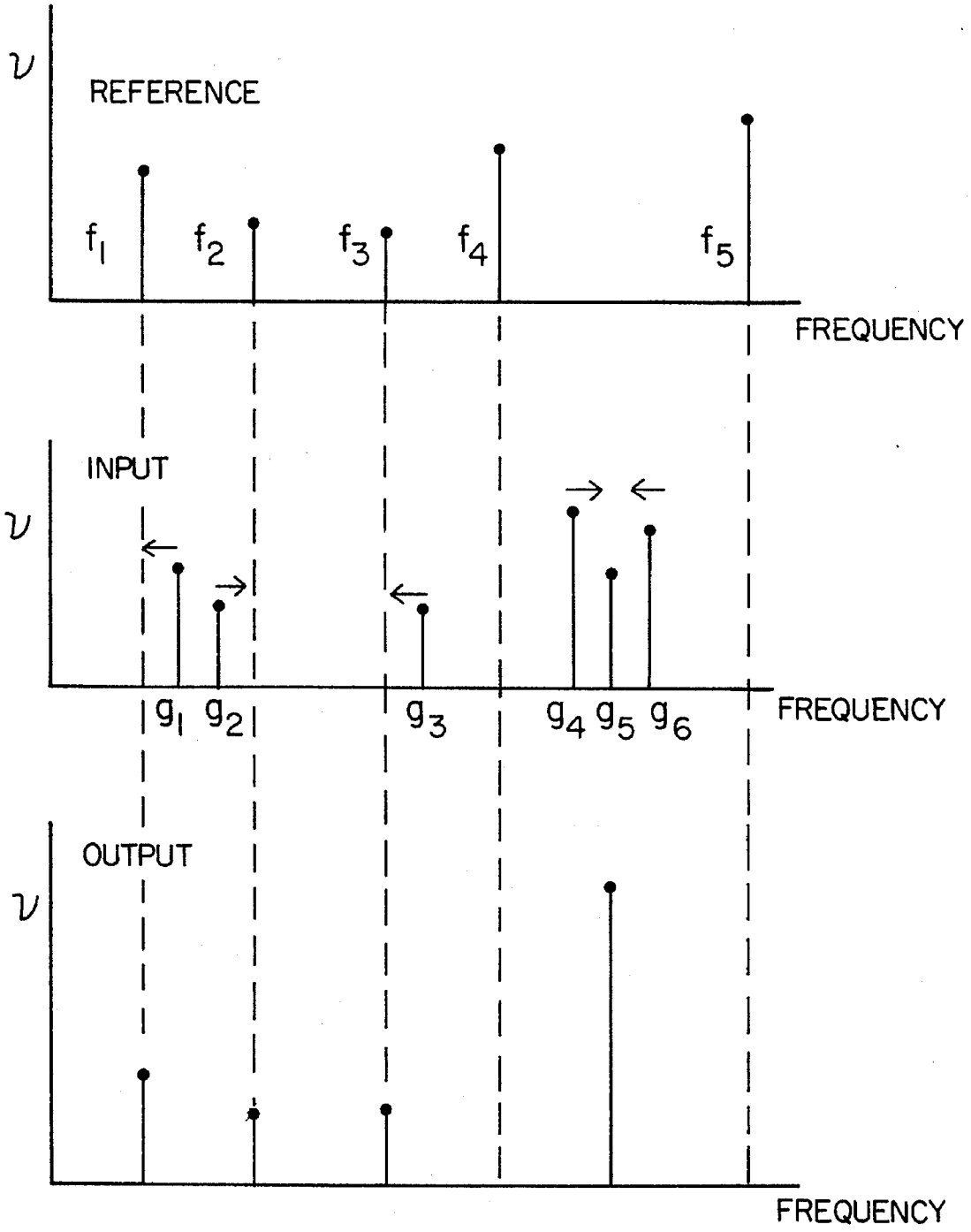
FIG. 7 is a set of spectra showing a set of reference partials, a set of input partials and a set of output partials produced in accordance with the present invention.

The iterative method of dissonance reduction may be applied using reference partials $f_1, f_2, f_3 \ldots f_5$ shown in FIG. 7 and an input signal having partials at $g_1, g_2 \ldots g_6$ to minimize the dissonance between the input and the reference partials. As indicated by the arrows in the input partial graph, iterative dissonance reduction as described above may cause $g_1$ to converge to $f_1$; $g_2$ to converge to $f_2$; and $g_3$ to converge to $f_3$. The partials $g_4$, $g_5$ and $g_6$ merged together and assume a position (roughly) midway between $f_4$ and $f_5$. The final converged spectrum of output partials is shown in the output spectrum of FIG. 7.

EXAMPLE 3

Suppose that the gradient method described above is used to reduce the dissonance of seven input partials as shown in FIG. 2 with respect to seven reference partials having the same amplitude and interval pattern as shown in FIG. 2, and that the interval between the fundamental of the input partials and that of the reference partials falls slightly short of seven semitones. The total dissonance between the input signal and the reference signal is shown in FIG. 3 at $d_1$. As is evident from FIG. 3, the sounding of the input signal with the reference signal would be much less dissonant if the input signal were transposed slightly upward, i.e., if the frequency of the fundamental of the input signal and all the other partials were raised so that the dissonance falls to $d_2$. In effect, this requires that a new output signal be produced that has a fundamental of higher frequency than that of the input signal but the same timbral quality, i.e., the same pattern of partials above the fundamental. In other words, the pitch of the input signal must be changed.

The gradient of the total dissonance curve D for the entire set of input partials at point $d_1$ may be approximated using conventional computational methods. The gradient may then be multiplied by a predetermined scaling factor $\mu$, e.g., $\mu$=0.005. The product (which will be a negative number due to the decreasing gradient of the dissonance curve at point $D_1$) is subtracted from the frequency of the fundamental input partial to produce a trial fundamental of slightly higher frequency than the input fundamental, and the frequency of each of the other input partials is raised by a corresponding interval, to produce a series of trial partials. As is evident from FIG. 3, the total dissonance of the trial partials will be less than that of the input signal. The process may be repeated until the dissonance ceases to decrease, at which point a local minimum has been identified at $d_2$. At that point, the trial partials that yield the minimum dissonance are selected as output partials for the output signal.

EXAMPLE 4

To demonstrate one application of the present invention, the sound of a mis-tuned guitar sounding a musical composition was recorded using a DAT (Digital Audio Tape) recorder. An accompaniment constituting simple block chords corresponding to the guitar piece was played on a properly tuned keyboard instrument, and was likewise recorded on a DAT recorder. Both recordings included a digital time code signal or "click track" so that their respective time domains could be matched together. The guitar part was used as the input signal, and the keyboard part was used as the reference signal. The DAT signals were fed to a personal computer programmed using a language called MATLAB to implement the iterative, gradient-based dissonance reduction method described above using the dissonance function defined in Equation 1(B), a scaling factor $\mu$=0.005 and a pitch differential $\delta$=0.2 cents. The resulting output guitar signal was recorded, and sounded more harmonious than the original input signal when played together before dissonance was reduced in accordance with the present invention.

While the invention has been described in detail with respect to specific preferred embodiments thereof, it is to be understood that upon a reading of the foregoing description, variations to the specific embodiments disclosed may occur to those skilled in the art and it is intended to include such variations within the scope of the appended claims.

What is claimed is:

1. A method for producing an electronic audio output signal from an electronic audio input signal comprising at least one partial, the method comprising:

a) identifying by frequency and amplitude at least one input partial of the input signal;

b) calculating the dissonance between at least one of the input partials identified in step (a), designated a "dissonant partial", and a plurality of reference partials;

c) identifying by frequency and amplitude a tuned partial near to the at least one dissonant partial, the tuned partial having the same amplitude as the dissonant partial and a frequency giving the tuned partial a dissonance that differs in a predetermined way from that of the dissonant partial relative to the reference partials; and d) producing an electronic audio output signal comprising the input partials except for the at least one dissonant partial; and further comprising each tuned partial identified in step (c) above.

2. The method of claim 1 wherein identifying the tuned partial comprises identifying a trial partial having an amplitude corresponding to that of the dissonant partial and having a frequency within a predetermined interval from that of the dissonant partial; calculating the dissonance for the trial partial, and choosing the trial partial as a tuned partial for the dissonant partial if the dissonance of the trial partial differs in a predetermined manner from the dissonant partial.

3. The method of claim 2 comprising choosing the trial partial as a tuned partial if its dissonance is less than that of the dissonant partial.

4. The method of claim 2 comprising choosing the trial partial as a tuned partial if its dissonance is greater than that of the dissonant partial.

5. The method of claim 1 wherein the reference partials are selected from the input signal.

6. The method of claim 1 wherein the reference partials are selected from a reference signal separate from the input signal.

7. The method of claim 1 wherein the input signal is an analog signal and wherein identifying the at least one input partial comprises analyzing the input signal to yield a frequency and amplitude domain.

8. The method of claim 1 wherein identifying an input partial comprises associating with the input partial a frequency $f_i$ and an amplitude $v_i$, wherein each reference partial has associated therewith a frequency $f_j$ and an amplitude $v_j$; and wherein the dissonance calculated in step (c) is designated D and is calculated as follows:

$$D = 1/2 \sum_{i=1}^{n+m} \sum_{j=1}^{m+n} d(f_i, f_j, v_i, v_j),$$

wherein: d ($f_i$, $f_j$, $v_i$, $v_j$) defines a dissonance function that reaches a maximum dissonance at about the critical interval for frequencies $f_i$ and $f_j$.

and n=the number of input partials, and m=the number of reference partials.

9. The method of claim 8 wherein choosing the tuned partial comprises determining the dissonance gradient for the dissonant partial and multiplying the gradient by a scaling factor μ to produce a frequency differential, choosing a trial partial having a frequency that differs from that of the dissonant partial by the frequency differential as the tuned partial.

10. The method of claim 9 further comprising comparing the frequency differential to a predetermined limit δ and treating the trial partial as a dissonant partial to produce a new trial partial until the frequency differential is less than or equal to δ or until a local minimum dissonance is reached, and choosing the final trial partial as the tuned input partial.

11. The method of claim 8 wherein the input signal comprises a plurality of dissonant partials, the method further comprising choosing a tuned partial for each dissonant partial by determining a dissonance gradient for the input signal as it changes in pitch, multiplying the gradient by the scaling factor μ to yield a pitch differential, and choosing as tuned output partials a plurality of trial partials whose frequencies differ from those of their respective dissonant partials by the pitch differential.

12. The method of claim 11 further comprising comparing the pitch differential to a predetermined limit δ and treating the trial partials as dissonant partials to produce new trial partials until the pitch differential is less than or equal to δ, or until a local minimum dissonance is reached, and choosing the final trial partials as tuned partials.

13. The method of claim 8 wherein the dissonance function is in the form $$d(f_i, f_j, v_i v_j) = v_i, v_j(e^{-a\Delta f} - e^{-b\Delta f})$$

wherein: a is from about 0.5 to about 5.0, b is from about 1 to about 10, and wherein $\Delta f = f_i - f_j$.

14. The method of claim 1 wherein identifying the at least one input partial comprises at least one of (a) selecting a timbre and assigning the timbre to an input pitch designated through use of a MIDI controller device, and (b) passing an analog electronic input signal through an analog to a digital converter and a frequency analyzer means to derive an input partial spectrum from the analog input signal.

15. The method of claim 1 further comprising at least one of (a) selecting the reference partials by selecting a timbre and assigning the timbre to a pitch through use of a MIDI controller device and (b) passing an analog reference signal through an analog-to-digital converter and frequency analyzer means to derive a spectrum of reference partials from the analog reference signal.

16. The method of claim 14 further comprising at least one of (a) selecting the reference partials by selecting a compatible timbre and assigning the timbre to a pitch through use of a MIDI controller device and (b) passing an analog reference signal through an analog-to-digital converter and frequency analyzer means to derive a spectrum of reference partials from the analog reference signal.

17. A method for producing a MIDI output signal comprising:

a) using a MIDI controller device to designate one or more pitches;

b) identifying a timbral spectrum to be associated with the pitches designated in step a) to define a spectrum of input partials each having a frequency $f_i$ and amplitude $v_i$;

c) calculating the dissonance of the input partials with respect to a set of reference partials each having a frequency $f_j$ and amplitude $v_j$;

d) identifying an output pitch at which the input partials define a local minimum dissonance relative to the reference partials; and e) producing an output MIDI signal that associates the previously identified timbral spectrum with the output pitch.

18. The method of claim 17 wherein the dissonance is designated D and is calculated as follows:

$$D = 1/2 \sum_{i=1}^{n+m} \sum_{j=1}^{m+n} d(f_i, f_j, v_i, v_j),$$

wherein: d ($f_i$, $f_j$, $v_i$, $v_j$) defines a dissonance function that reaches a maximum dissonance at about the critical interval for frequencies $f_i$ and $f_j$, and n=the number of input partials, and m=the number of reference partials.

19. The method of claim 18 wherein the input signal comprises a plurality of dissonant partials, the method further comprising choosing a tuned partial for each dissonant partial by determining a dissonance gradient for the input signal as it changes in pitch, multiplying the gradient by the scaling factor μ to yield a pitch differential, and choosing as tuned output partials a plurality of trial partials whose frequencies differ from those of their respective dissonant partials by the pitch differential.

20. The method of claim 19 further comprising comparing the pitch differential to a predetermined limit δ and treating the trial partials as dissonant partials to produce new trial partials until the pitch differential is less than or equal to δ, or until a local minimum dissonance is reached, and choosing the final trial partials as tuned partials.

21. The method of claim 18 wherein the dissonance function is in the form $$d(f_i, f_j, v_i v_j) = v_i, v_j(e^{-a\Delta f} - e^{-b\Delta f})$$

wherein: a is from about 0.5 to about 5.0, b is from about 1 to about 10, and wherein $\Delta f = f_i - f_j$.

22. A device for changing the dissonance of an electronic audio input signal, comprising:

a) input signal means for receiving an audio input signal comprising at least one input partial;

b) reference signal means for identifying by frequency and amplitude a plurality of reference partials;

c) dissonance analyzer means for calculating the dissonance of at least one of the input partials, designated a dissonant partial, relative to the reference partials and for identifying by frequency and amplitude a tuned partial near each dissonant partial, the tuned partial having a dissonance that differs from the dissonance of its respective dissonant partial in a predetermined way, the amplitude of the tuned partial being the same as the amplitude of the respective dissonant partial; and d) synthesizer means for producing an output signal comprising the input partials except for each dissonant partial and further comprising each tuned partial identified by the dissonance analyzer means.

23. The device of claim 22 wherein at least one of the reference signal means and the input signal means comprises an analog-to-digital converter and frequency analyzer means for identifying by frequency and amplitude one or more partials of an analog signal.

24. The device of claim 23 wherein at least one of input signal means and the reference signal means comprises a plurality of bandpass filters.

25. The device of claim 22 wherein the synthesizer means comprises reverse Fourier transform means to produce a digital audio output signal from the output partials.

26. The device of claim 21 wherein at least one of the input signal means and the reference signal means comprises a MIDI controller device and a MIDI compatible timbre source means operably connected to the controller device for assigning a timbral spectrum to a pitch designated by the controller device.

* * * * *